United States Patent [19]

Pfanstiel

[11] Patent Number: 4,846,371

[45] Date of Patent: Jul. 11, 1989

[54] DISPENSING DEVICE FOR PASTES, CREAMS OR SIMILAR AGENT OF A PARTICULARLY HIGH VISCOSITY

[76] Inventor: Erich Pfanstiel, 7853 Steinen-Kirchhausen, Fed. Rep. of Germany

[21] Appl. No.: 140,113

[22] Filed: Dec. 31, 1987

[30] Foreign Application Priority Data

Jan. 3, 1987 [DE] Fed. Rep. of Germany ..... 3700120

[51] Int. Cl.[4] ..... B67D 5/60

[52] U.S. Cl. ..... 222/135; 222/144.5; 222/391

[58] Field of Search ..... 222/135, 340, 136, 145, 222/391, 409, 322, 94, 129, 144.5

[56] References Cited

U.S. PATENT DOCUMENTS

| | | | |
|---|---|---|---|
| 3,255,935 | 6/1966 | Spatz | 222/391 X |
| 4,046,288 | 9/1977 | Bergman | 222/135 |
| 4,240,566 | 12/1980 | Bergman | 222/135 |
| 4,261,481 | 4/1981 | Speer | 222/135 |
| 4,437,584 | 3/1984 | Connors | 222/391 X |
| 4,461,403 | 7/1984 | Prahs | 222/391 X |
| 4,643,337 | 2/1987 | Heck et al. | 222/391 X |
| 4,749,106 | 6/1988 | Von Schuckmann et al. | 222/105 X |

FOREIGN PATENT DOCUMENTS

| | | | |
|---|---|---|---|
| 3318892 | 11/1984 | Fed. Rep. of Germany | 222/391 |

*Primary Examiner*—Joseph J. Rolla
*Assistant Examiner*—Gregory L. Huson
*Attorney, Agent, or Firm*—Barnes & Thornburg

[57] ABSTRACT

A dual agent dispensing container has plural chambers with a single independently acting agent dispensing mechanism in each chamber. The dispensing mechanism includes a key operating a push rod connected to a plunger via a one-way acting spring drive. The dispenser can be utilized to dispense plural agents together or separately in time.

19 Claims, 3 Drawing Sheets

DISPENSING DEVICE FOR PASTES, CREAMS OR SIMILAR AGENT OF A PARTICULARLY HIGH VISCOSITY

BACKGROUND OF THE INVENTION

The invention relates to a dispensing container for dispensing plural agents wherein there is a vertical dividing wall between two agent storage chambers of the same volumetric capacity. In each chamber there is a lever push rod operating mechanism actuated by means of a push key to move a half shell plunger which forces release of the agent from the dispenser.

RELATED ART

Dispensing devices of varying constructions are known and have exhibited good results for tooth paste, liquid soap, or the like. However, they exhibit a disadvantage in that they can hold only one particular cream, paste or similar filling agent.

SUMMARY OF THE INVENTION

In numerous applications, it is desirable to simultaneously dispense related to two different agents, or to dispense them simultaneously (offset with respect to time) which agents, because of their intended purpose, are adapted to be used with one another to provide a desired effect.

Examples of such related or two different agents are: a day cream and a night cream—or a tooth paste for the morning and for the evening with respective deviating effects—or a preliminary cleaning tooth paste to be followed immediately afterwards with another tooth paste that forms a protective film.

An object of the invention is to provide a dispenser for making these types of different substances available in a single dispensing device for utilizing the advantages of these relates or different substances. Prior to this time, two containers had to be used for such a dual dispensing operation. This not only has the disadvantage that the two dispensing devices may possibly be mixed up by the user, but also that more space is required for making these dispensing devices readily available.

The invention is therefore based on an objective of providing a dispensing device of the initially mentioned type by means of which two different agents can be made available simultaneously or successively (offset with respect to time) and wherein the agent can be taken out of the dispenser as uniformly as possible, without requiring two individual dispensing devices. This objective is achieved by the fact that the dispensing device has two interior spaces that are separated from one another. Each of these interior spaces independently of one another, has a bottom half-shell dispensing plunger that moves up when the volume is reduced. A push rod system, actuated by an exterior push key as the operating mechanism is used, to actuate the half-shell plungers utilizing a lever to operate the rod which is connected to drive the half-shell plunger through a one-way spring connection.

Another advantage of the invention is that the operating mechanism requires no restoring force to be overcome during the upward movement of the push key during the pressing-out or dispensing of the agent in the dispenser. Upward movement of the push key causes a lever movement that raises the rod system with the half-shell plunger, and thus the agent resting on top of the half-shell plunger is pulled upward and pressed out of the dispenser. Downward movement of the push key causes the rod system to move downward to overcome a one-way drive supporting spring on the bottom of the half-shell plunger without movement of the half-shell plunger, while at the same time allowing the key to move back to its first position to then be ready again for dispensing of the agent.

These and other objects, features, and advantages of the present invention will become more apparent from the following description when taken in connection with the accompanying drawings which show, for the purposes of illustration only, one embodiment in accordance with the present invention, and wherein:

DETAILED DESCRIPTION OF THE DRAWINGS

Figure 1:
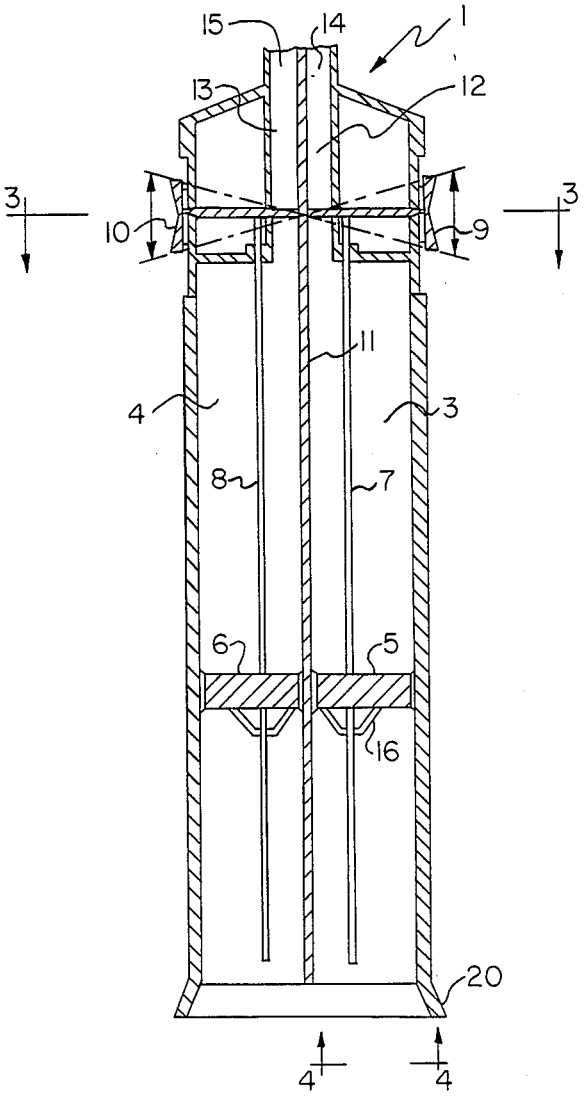
FIG. 1 shows a cross-sectional view of the dispenser exhibiting plural dispensing chambers.

Referring now to the drawings wherein like reference numerals are used to designate like parts and more particularly to FIG. 1 wherein a dual agent dispenser shown generally at 1 is provided with spaces 3 or 4 that are separated from one another by a dividing wall 11. These spaces 3 and 4 are approximately the same size and hold the agents to be dispensed. Each interior space 3 or 4 has at its bottom end a half-shell plunger 5 or 6 that moves upwardly behind the reducing volume of the agent during a dispensing operation. Each space 3 or 4 also has an independently operating actuating mechanism including a push rod 7 or 8 for causing upward movement of the half-shell plunger 5 to 6 and release of the agents through feeding device passageways 12 or 13 leading to outlet openings 14 or 15.

Figure 2:
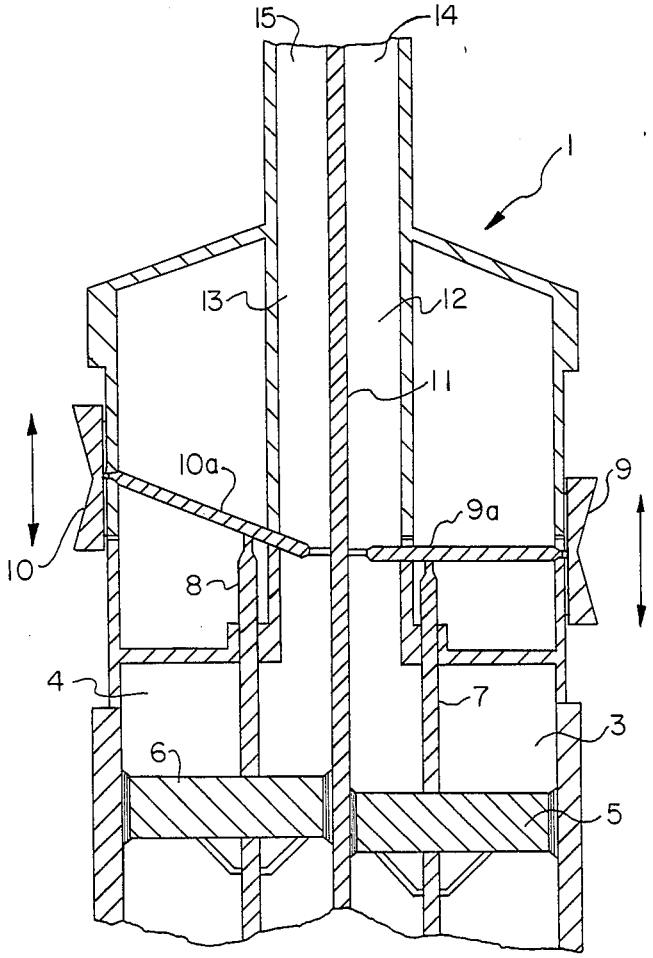
FIG. 2 is an enlargement of the actuating mechanism for the plural dispensing chambers with one chamber in a dispensing mode and the other chamber for dispensing.
Figure 3:
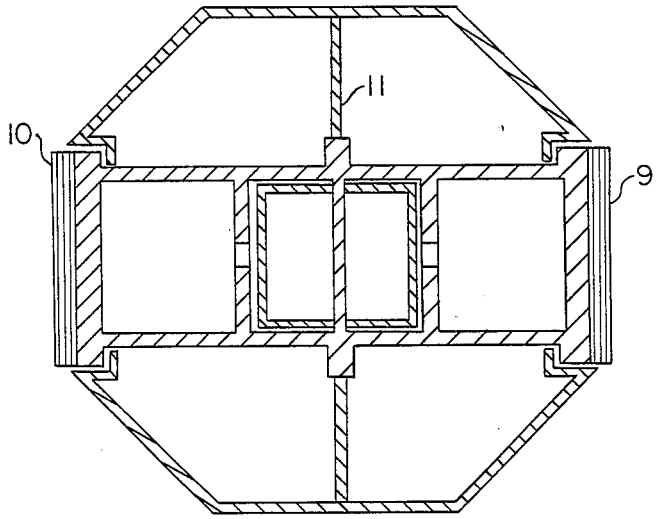
FIG. 3 is a cross-section of the dispenser taken along line 3—3 of FIG. 1.
Figure 4:
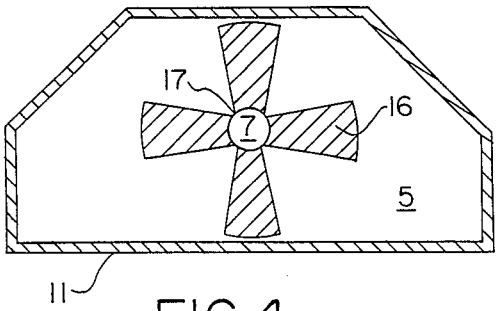
FIG. 4 is a bottom view of one dispensing chamber looking upwards along the direction of lines 4—4 of FIG. 1.

The two push rods 7 and 8 are attached to operating push keys 9 or 10 via key extensions 9(*a*) and 10(*a*). Upward movement of a push key raises its push rod which passes through an opening 17 (see FIG. 4 and not shown in FIGS. 1 and 2) in the half-shell plungers and is gripped by spring 16 below the half-shell plunger. The spring is attached at its periphery to the half-shell plunger and allows for a one-way drive between the push rod and the half-shell plunger. When the rod moves upwardly the spring grabs the rod and forces the half-shell plunger to move upwardly. Upon upward movement of the half-shell plunger, the mass of agent located above it is pushed out of the respective storage chambers 3 or 4 into passageway 12 or 13 and out the opening 14 or 15.

Downward movement of the push key causes the push rod to overcome the supporting spring of the half-shell plunger without movement of the half-shell plunger and thus allows the push key to then be ready again for the dispensing of the agent. Thus, the spring 16 acts as a one-way motion transmission mechanism between the rod and the half-shell plunger. The arrows and inclined lines adjacent the push keys show the extent of movement of the push keys.

The agent can be loaded into the dispenser through the outlet openings 14, 15 or by removing the plungers from the push rods, cut the bottom of the chamber, by separating the spring from the rod and pulling the half-shell plunger out the bottom 20 of the dispenser. When filling from the top the plunger still has to be released from the rods through the bottom opening, although it does not have to be removed from the chamber. after filling, the half-shell plunger, if removed, is upwardly forced onto the rod until the spring once again grips the rod. The octagonal shape of the dispenser keeps the half-shells from rotating about the rods and also assists in keeping the half-shell plungers from canting in the chambers 3 or 4. The cross-section of the dispenser could be cylindrical however.

While the dispenser is shown as having two dispensing chambers it is equally possible to have more than 2 chambers with independent actuating means if more than two agents are to be dispensed.

While I have shown and described only one embodiment in accordance with the present invention, it is understood that the same is not limited thereto but is susceptible to numerous changes and modifications as known to one having ordinary skill in the art, and I therefore do not wish to be limited to the details shown and described therein, but intend to cover all such modifications as are encompassed by the scope of the appended claims.

I claim:

1. A dispensing device for plural agents, wherein a container has a vertical dividing wall separating the container into at least two storage chambers with each chamber having an independently actuatable dispensing means for one agent including: a reciprocating push rod means; an operating key means connected to reciprocate the push rod means and to move the push rod means upwardly for dispensing; and plunger means connected by a one way motion transmitting mechanism to the push rod means that moves upwardly in response to movement of its operating key means to dispense an agent located above the plunger means and does not move downwardly upon reciprocation of the push rod means downwardly by the operating key means.

2. A dispensing device according to claim 1, wherein the push key means are free to move and are not biased to return to any previously moved to position by any restoring force.

3. A dispensing device according to claim 1, wherein the plunger means comprises half shells.

4. A dispensing device according to claim 3, wherein the push key means are free of any restoring force.

5. A dispensing device according to claim 3, wherein the half-shell plunger is disconnected from the push rod for filling of the dispenser.

6. A dispensing device according to claim 3, wherein each rod is connected to each half-shell by the one-way motion transmitting mechanism.

7. A dispensing device according to claim 6, wherein the push key means are free of any restoring force.

8. A dispensing device according to claim 6, wherein the one-way transmitting mechanism is a spring means attached to the half-shell.

9. A dispensing device according to claim 8, wherein the push key means are free of any restoring force.

10. A dispensing device according to claim 1, wherein the container vertical dividing wall divides the container into two substantially equal sized storage chambers.

11. A dispensing device according to claim 10, wherein wherein the push key means are free to move and are not biased to return to any previously moved to position by any restoring force.

12. A dispensing device according to claim 10, wherein the dividing wall for the separating of the at least two supply chambers is continued upwardly to define outlet means for the at least two supply chambers.

13. A dispensing device according to claim 12, wherein the outlet means is also utilized as an inlet for filling the dispenser.

14. A dispensing device according to claim 10, wherein the plunger means comprises half shells.

15. A dispensing device according to claim 14, wherein the push key means are free of any restoring force.

16. A dispensing device according to claim 14, wherein each rod is connected to each half-shell by the one-way motion transmitting mechanism.

17. A dispensing device according to claim 16, wherein the push key means are free of any restoring force.

18. A dispensing device according to claim 16, wherein the one-way transmitting mechanism is a spring means attached to the half-shell.

19. A dispensing device according to claim 18, wherein the push key means are free of any restoring force.

* * * * *